US005679416A

United States Patent [19]

Cheng

[11] Patent Number: 5,679,416

[45] Date of Patent: Oct. 21, 1997

[54] FULL ROSETTE BOW FOR DECORATING GIFTS

[76] Inventor: Peter S. C. Cheng, 99 Glencairn Ave., Toronto, Ontario, Canada, M4R 1M7

[21] Appl. No.: 693,817

[22] Filed: Jul. 9, 1996

[51] Int. Cl.[6] ..... D04D 7/10

[52] U.S. Cl. ..... 428/5; 428/4; 428/101; 223/46

[58] Field of Search ..... 428/4, 5, 24, 101; 223/46; 156/70

[56] References Cited

U.S. PATENT DOCUMENTS 4,515,837 5/1985 Cheng ..... 428/4

*Primary Examiner*—Alexander Thomas

*Attorney, Agent, or Firm*—Kirschstein, et al.

[57] ABSTRACT

An adorning article includes a pair of elongated ribbons subdivided into consecutive segments connected in succession by respective neck portions, a pair of drawstrings, and a multitude of retainer members that are applied to the neck portions to connect them to one another. Each of the ribbons includes a stem portion and a branch portion merging with one another at a merger region. At least one of the segments of each of the branch portions is folded back into juxtaposition with an adjacent segment of the same branch portion and is connected by a respective retainer member to that of the neck portions that connects the adjacent segment with the next one.

17 Claims, 1 Drawing Sheet

FULL ROSETTE BOW FOR DECORATING GIFTS

BACKGROUND OF THE INVENTION

1. Field of the Invention

The present invention relates to decorations in general, and more particularly to an adorning article exhibiting a pom-pon appearance in its final state and intended to be attached to a gift package or the like for decorative purposes.

2. Description of the Related Art

There are already known various constructions of adorning articles of the type here under consideration, among them such that are being sold in its final, puffed-up state. Obviously, such articles occupy a considerable amount of space that is often at a premium, be it in storage, in transportation or on display. This problem has been recognized before, and a remedy was found in a ribbon having a drawstring loosely connected to it at spaced points along its length and secured to the ribbon at one end so that the user of the ribbon can draw the ribbon into a number of arcuate loops by pulling on the drawstring. An obvious advantage of this arrangement is that the ribbon can be packed flat, thus greatly facilitating and reducing the cost of storage and transport of the items as compared to those encountered with preformed bows that are relatively bulky and need to be packed in crush-proof containers.

Such prior art devices have, however, suffered from the disadvantage that, on pulling on the drawstring, the ribbon had tended to fold itself into loops aligned along a single vertical plane, thus forming a fan shape. This represents a pronounced inconvenience to the ultimate user who normally requires the bow to be arranged in a more decorative rosette or pom-pon form, and makes it necessary for the user to pull on the individual loops to displace them laterally in an effort to rearrange them so that they are spaced angularly around the axis of the bow. Apart from being time-consuming, this manipulation presents the risk of the bow becoming torn, damaged or soiled in the process.

This problem was addressed in U.S. Pat. No. 4,515,837 to Cheng, in that the ribbon arrangement provided therein includes two ribbons each including a plurality of consecutive segments connected to one another by respective narrow neck portions, the ribbons being connected to one another at the respective neck portions by respective retainer members which, due to the configurations of the neck portions, are caused to assume slightly inclined positions relative to the transverse width of the ribbons. With this ribbon arrangement, as the bow is being formed by pulling on the drawstring, each of the relatively stiff retainer members tends to seat itself on the bow loop that is being formed immediately adjacent thereto in an angularly skewed orientation relative to the latter, and thus imparts a bias tending to skew each loop of the bow relative to the previously formed loop, so that the loops are arranged in an angularly spaced rosette or pom-pon-like form.

As advantageous as this arrangement may be, experience with it has shown that it still leaves something to be desired as far as the appearance of the article in its final or finished form is concerned. More particularly, it was established that the top of the resulting article is somewhat relatively flat, that is, while there is obtained automatic distribution of the loops about the axis of the drawstring, no bias to speak of is applied to the loops to force the topmost ones of them to spread, against the force of gravity, into the empty space above them. This, of course, means that articles of this type are somewhat at a disadvantage as far as their appearance is concerned relative to the preformed pom-pon-like bows that are usually made much fuller on top.

OBJECTS OF THE INVENTION

Accordingly, it is a general object of the present invention to avoid the disadvantages of the prior art.

More particularly, it is an object of the present invention to provide an adorning article in the form of a pom-pon that does not possess the drawbacks of the known articles of this type.

Still another object of the present invention is to devise an adorning article of the type here under consideration which has the look virtually indistinguishable from that of a professionally preformed article of this kind even though formed on site just prior to its use.

It is yet another object of the present invention to design the above adorning article in such a manner as to give it a much fuller, fluffier appearance than before in its finished form.

A concomitant object of the present invention is so to construct the adorning article of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an adorning article that includes as its components a pair of elongated ribbons. Each of these ribbons includes a stem portion and a branch portion merging with one another at a merger region. Each such ribbon is subdivided into a predetermined number of successive segments located both on the stem and branch portions thereof and interconnected with one another by respective intervening neck portions formed, in each instance, by a pair of incisions extending from respective edges of the respective one of the ribbons within the stem and branch portions and at the merger region toward each other but terminating short of meeting each other to define the respective one of the neck portions. At least one of the segments of each of the branch portions is folded back into juxtaposition with an adjacent segment of the same branch portion.

The article further includes means for connecting the ribbons to one another at each of the neck portions located on the stem portion between the successive segments and at the merger region, and the at least one folded-back segment of each of the branch portions to that of the neck portions that connects the adjacent segment with the next one, and a pair of drawstrings sandwiched between the stem portions of the ribbons, passing jointly through the neck portions of the stem portion and of the merger region and individually through the neck portions of the branch portions and between the folded-over and adjacent segments, with freedom of longitudinal movement, and each separately secured to a fold region present between the folded-over and adjacent segments. A particular advantage of this arrangement is that the ribbon material of the branch portions tends to fluff up, due to the interaction between the branch portions during the bow formation process, to a much greater extent than what could be attributed merely to the presence of additional ribbon material at the affected location.

Advantageously, each of the branch portions includes at least one segment situated next to the merger region that has no other of the segments of the same branch associated with it, so that it constitutes a weakened region at which deformation of the segments into loops preferentially commences in response to pulling on the drawstrings. It is also advantageous when the connecting means includes a multitude of individual retainer members, at least those of which that are disposed on the stem portions of the ribbons being inclined at predetermined angles with respect to the transverse width of the ribbons.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
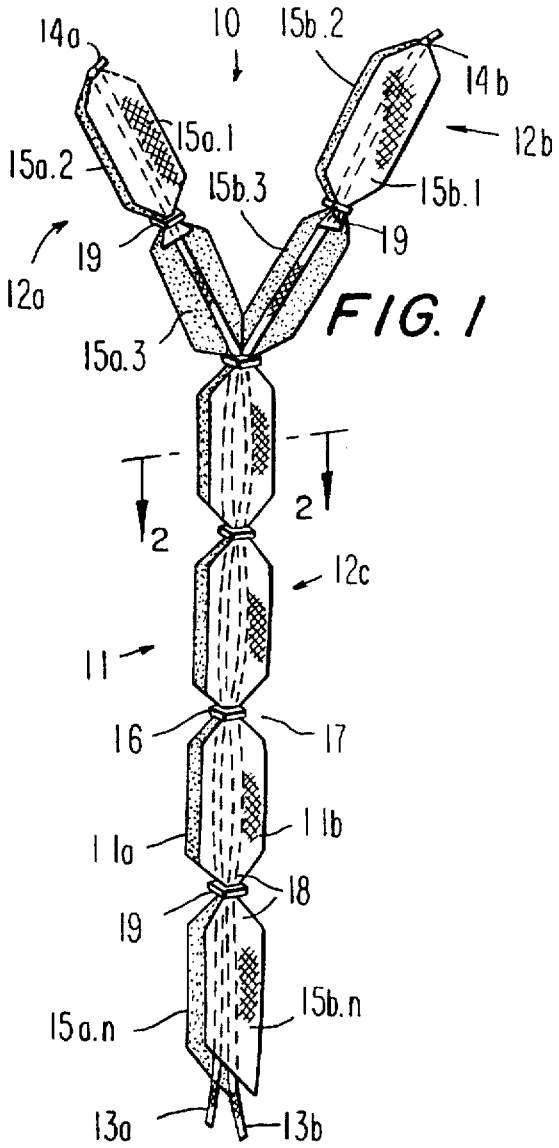
FIG. 1 is a perspective view of an adorning article according to the present invention in its initial, bow precursor, state.

Referring now to the drawing in detail, and first to FIG. 1 thereof, it may be seen that the reference numeral 10 has been used therein to identify an article embodying the present invention, in its entirety. Inasmuch as the ultimate utility of the article 10 is to adorn a gift-containing package or for other decorative purposes, it will be referred to herein generally as an adorning article even when not yet deserving that designation because of not having attained its final decorative shape yet.

Figure 2:
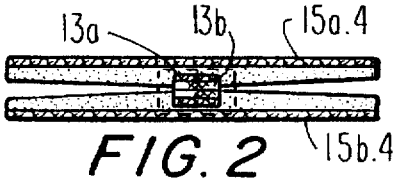
FIG. 2 is a cross-sectional view, on a somewhat enlarged scale, taken on line 2—2 through the article of FIG. 1.

In accordance with the present invention, the article 10 includes as one of its main components a ribbon arrangement 11. The ribbon arrangement 11 includes a pair of generally ribbon-shaped main sections or members 11*a* and 11*b* disposed in face-to-face relationship. The members or ribbons 11*a* and 11*b* are advantageously formed by taking a length of ordinary but decorative (colored and/or patterned) ribbon material, e.g. any suitable commercially available synthetic plastic material having a satin-like fibrous texture, cutting it in half, and then juxtaposing the thus obtained discrete ribbons 11 and 12 in aligned relationship with one another, as may be discerned particularly from a comparison of FIG. 1 with FIG. 2 of the drawing.

As shown particularly in FIG. 1, the ribbon arrangement 11 is bifurcated, that is it includes a pair of auxiliary portions or branches denoted by the reference numerals 12*a* and 12*b*, respectively, that merge with each other to form a main portion or stem 12*c*. It will be appreciated that the article 10 can be stored indefinitely in its substantially flat original state (not shown) in which the branches 12*a* and 12*b* lie substantially flat against one another, forming respective continuations of the stem 12*c* that extend along a common plane with the stem 12*c*, albeit possibly with the article 10 being folded one or more times upon itself. However, as will become clearer later, the article 10 can be easily and quickly converted, when the need for it arises, from this original state through its initial and partially deformed precursor states illustrated in FIGS. 1 and 3, respectively, to its final bow state visible in FIG. 4.

The article 10 further includes an operating drawstring arrangement 13. As shown, and as currently preferred, the drawstring arrangement 10 includes a pair or individual drawstrings 13*a* and 13*b*; however, it is also possible and contemplated by the present invention for the two drawstrings 13*a* and 13*b* to be of one piece with one another, being folded at their lower ends, or connected to each other in some other fashion, such as by a knot, at a region situated below the ribbon arrangement 11, both as considered in FIG. 1. Such a connection would help in insuring identical or commensurate movement of the drawstrings 13*a* and 13*b* when pulled on; on the other hand, it would render manipulation with the strings 13*a* and 13*b* following such movement difficult and in many instances require severance of or a similar breakage or discontinuance of such connection or bond prior to such manipulation. In the final analysis, the decision on whether or not to have the strings 13*a* and 13*b* joined will be made based on a plurality of factors including those mentioned above. The drawstring arrangement 13, or each of its constituent parts 13*a* and 13*b*, may be made of the same material as the ribbon arrangement 11 but of a much narrower width at least in its final form.

The drawstrings 13*a* and 13*b* are connected to the ribbons 11*a* and 11*b*, respectively, in a manner and at locations yet to be described; however, before addressing that issue, the ribbons 11*a* and 11*b*, their configuration and function, and the way they are connected, will be discussed in some detail. As best seen in FIG. 1, each ribbon 11*a* and 11*b* includes a series of respective segments 15*a*.1 to 15*a.n* or 15*b*.1 to 15*b.n*, wherein n is any chosen integer (in the illustrated embodiment, seven) within reason. The segments 15*a*.1 to 15*b.n* are obtained in the ribbons 11*a* and 11*b*, which were substantially equally wide throughout to begin with, by forming respective substantially V-shaped indentations or incisions 16 and 17 that are cut or otherwise made on the opposite sides of the ribbon members 11*a* and 11*b*.

It may be seen that the segment 15*a*.1 is folded back along a folding line or crease 14*a* to become juxtaposed with the segment 15*a*.2; the same is true with respect to the segment 15*b*.1 vis-a-vis the segment 15*b*.2. Moreover, even though that is not shown in the drawing, there could be provided two or more other segments (which could be referred to as segments 15*a*.0 and 15*b*.0 for the sake of consistency, even though they are not shown in the drawing) that would then be juxtaposed with the segments 15*a*.2 and 15*b*.2, respectively, etc. The "folded-back" segment or segments can be of one-piece with the main ribbon sections 11*a* and 11*b*, or they can be discrete auxiliary ribbon sections.

Advantageously, all of the segments 15*a*.1 to 15*b.n* have substantially equal lengths, but that is not critical. As a matter of fact, in some cases it may be even preferred to make them of unequal lengths; even in that case, though, the associated ones of the segments 15*a*.1 to 15*b.n*, that is those that are directly juxtaposed with one another (such as, for example, 15*a*.4 and 15*b*.4 or, for that matter, 15*a*.1 and 15*a*.2) do have substantially equal lengths.

For the sake of completeness, it is to be mentioned that, the indentations 16 and 17 are offset, like in the above-cited patent, longitudinally from one another on the opposite edges of the ribbons 11*a* and 11*b* so that a narrow neck portion 18 is formed between each pair of indentations 16 and 17 that has its narrowest portion inclined at a small angle of, say, 30° to 40° with respect to the transverse width of the ribbons 11*a* and 11*b*. The successive pairs of indentations 16 and 17 are formed such that each neck portion 18 is inclined at an angle different from that of the respective preceding neck portion 18. In a currently preferred implementation, the absolute values of such angles are substantially the same, but each respective neck portion 18 is inclined in a direction from the transverse width of the ribbon members 11*a* and 11*b* which is opposite to that of the respective preceding or succeeding neck portion 18 as considered in the longitudinal direction of the ribbon arrangement 11.

A clip or retainer member 19 is applied around each neck portion 18. Each retainer member 19 is advantageously constituted by a small piece of sheet material that is relatively stiff compared to that of the ribbons 11*a* and 11*b*. The retainer member 19 may comprise, for example, a piece of relatively thin and stiff synthetic plastic material, e.g. a cellulose plastic material. The retainer member 19 is provided with a central aperture dimensioned to receive a sandwich including the narrow neck portions 18 of the ribbons 11*a* and 13*a* and 13*b* received between them, and has a slit extending from the central aperture all the way to its outer periphery to allow the introduction of the sandwich into the aperture. The retainer member 19 is applied by flexing it slightly to open the slit and by passing the sandwich through the thus widened slit. Once the sandwich is in the aperture, the flexing forces are discontinued and the slit closes again, keeping the sandwich securely in the aperture. Thereafter, the neck portions 18 are received in the aperture with a degree of snugness sufficient for the retainer member 19 to be restrained from moving longitudinally of the ribbons 11*a* and 11*b* and to adopt and maintain the orientation or inclination of the neck portions 18. Each retainer member 19 is thus inclined substantially at the same angle as the narrow neck portions 18 relative to the transverse width of the ribbons 11*a* and 11*b*. Yet, on the other hand, even the neck portions 18 of the ribbons 11*a* and 11*b* confine the drawstrings 13*a* and 13*b* loosely enough so that the drawstrings 13*a* and 13*b* can be pulled relatively freely between the neck portions 18.

When the retainer members 19 are constructed, and mounted on the ribbon arrangement 11, in the manner described above, then each of them is inclined, in the position of the adorning article 10 that is depicted in FIG. 1, at the same angle as the aligned neck portions 18, and is in the form of a small plate presenting planar upper and lower faces extending generally perpendicularly to a plane that is flanked by the ribbons 11*a* and 11*b*, these faces being inclined with respect to the transverse width of the ribbons 11*a* and 11*b*. In the example presented here, each of such retainer members is inclined in a direction or sense opposite to that of the respective preceding or succeeding retainer member 19.

While the construction of the retainer members 19 that has been described above is particularly advantageous, if for no other reason than because it does not require the use of any tools for the assembly of the retainer members 19 with the sandwich including the ribbon arrangement 11 and the drawstring arrangement 13, it is also contemplated by the present invention to use other constructions of the retainer members 19 instead, for instance, that including a length of a deformable metal wire encircling and clamped around the aligned neck portions 18. Even then, however, the principle of causing the retainer members 19 to assume respective inclined positions is adhered to. Moreover, as will be appreciated, in order to locate the retainer members 19 on and orientate them at the desired angles with respect to the ribbons 11*a* and 11*b*, it is not absolutely necessary (albeit it is advantageous) to give the indentations 16 and 17 the illustrated V-shape. Rather, to give an example, a simple cut may be formed inwardly from each edge of each of the ribbons 11*a* and 11*b*, such cuts being substantially aligned with one another as between the ribbons 11*a* and 11*b* but offset from one another as far as the respective ribbon 11*a* or 11*b* is concerned to provide respective narrow lands or intervening portions around which the retainer member 19 may be clipped.

In those respects that have been described above, the adorning article 10 has so much in common with that described in the above patent that reference may be had to the latter for any details that may need clarification. However, the article 10 of the present invention also differs from that described in the patent in details that are both substantial and substantive.

More particularly, as already mentioned before, the article 10 of the present invention includes the two branches 12*a* and 12*b* that effectively double or at least substantially increase the amount of the ribbon material that is available beyond the stem 12*c* for the formation of a bow. It should be noted in this respect that the drawstrings 13*a* and 13*b*, while passing side-by-side with one another through the stem 12*c*, are separated at the upper end of the stem 12*c* as considered in FIG. 1 to each individually enter a different one of the branches 12*a* and 12*b* and pass next to and/or between the segments 15*a*.3 (and 15*a*.0) and 15*a*.2 and 15*a*.1, on the one hand, and the segments 15*b*.3 (and 15*b*.0) and 15*b*.2 and 15*b*.1, respectively. They are connected, such as by respective knots, to the respective crease regions 14*a* and 14*b* situated between the segments 15*a*.1 and 15*a*.2 and 15*b*.1 and 15*b*.2 and/or to the respective retainer members 19 if present thereat (they would not have to be if those segments 15*a*.1 to 15*b*.2 were about one-half in length of the others, and in that case the indentations, incisions or notches 16 and 17 could be dispensed with as well at those locations). Of course, respective retaining members 19 are used to connect the free ends of the folded-over segments 15*a*.1 and 15*b*.1 to the neck portions 18 disposed between the segments 15*a*.2 and 15*a*.3 or 15*b*.2 and 15*b*.3.

Having so described the construction of the adorning article 10, its conversion from its substantially flat or developed precursor state of FIG. 1 to its final or bow state depicted in FIG. 4 of the drawing will now be explained in some detail. In use, the article 10, which is distributed and stored prior to use in its flat form, is converted into a decorative pom-pon or rosette-like bow by first grasping the free (lower) ends of the drawstrings 13*a* and 13*b* in one hand while simultaneously holding a portion of the segments 15*a*.*n* and 15*b*.*n* adjacent the retainer member 19 that is situated next to such free drawstring ends lightly between a finger and the thumb of the other hand. The drawstrings 13*a* and 13*b* are then pulled outwardly at about the same pace, with the affected finger and thumb of the aforementioned other hand being in engagement with the aforementioned retainer member 19, so that the segments 15*a*.1 to 15*b*.*n* are gathered up into respective loops.

Figure 3:
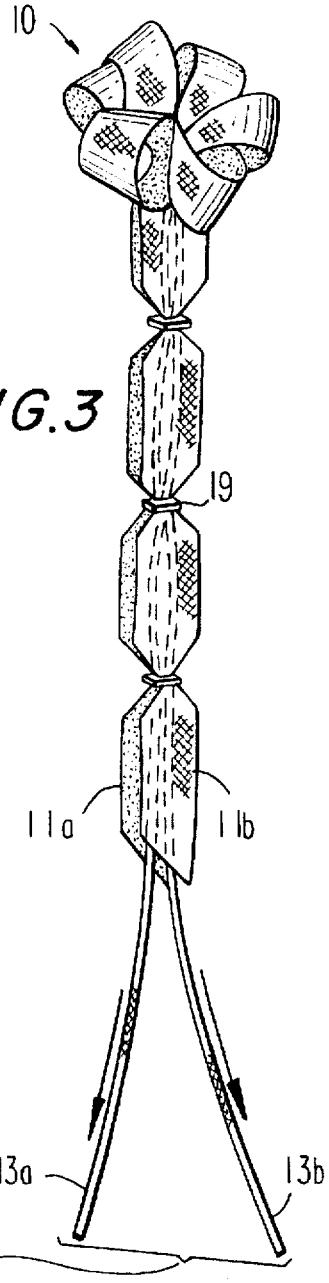
FIG. 3 is a view akin to that of FIG. 1 but taken during an initial stage of conversion of the precursor into a bow.

As revealed in FIG. 3 of the drawing, barring unforeseen complications, this gathering process commences at the two branches 12*a* and 12*b*, that is, with the segments 15*a*.1 to 15*b*.3 contained in them. This preference for the location at which the gathering process commences is attributable, at least in part, to the fact that the segments 15*a*.3 and 15*b*.3 are not doubled up, that is they do not have any counterparts juxtaposed with them, so that they constitute "weak links" in the chain of deformation. This overcomes any otherwise possibly existing tendency for the loops to start forming, due to frictional engagement of the drawstrings 13*a* and 13*b* with the neck portions 18 of the ribbons 11*a* and 11*b*, at the end portion at which the ribbons 11*a* and 11*b* are being held, or even elsewhere. It will be appreciated that such an improper commencement of the gathering process would result in irregularities in the loops which would have to be straightened out eventually, in a very laborious manner. Of course, once the gathering process has started properly, it will continue in the same fashion, that is from above to below as seen in FIG. 3 of the drawing, in that the already at least partially accomplished segment deformation will "feed forward" through the deformation chain.

Because of their angled orientations, the retainer members 19 tend to seat themselves on the bow loops at angularly skewed or offset orientations. As a result, the successive loops become skewed or angularly displaced relative to one another at different angles about the axis of the drawstring arrangement 13. In other words, instead of superimposing themselves onto one another, the loops become arranged at varying angles around the axis of the drawstring arrangement 1, to provide a desired rosette-like form at least at the region originating from the stem 12*c*.

The bifurcation of the adorning articles 10, however, brings about another and possibly even more important advantage. More particularly, in contradistinction to the situation encountered before when the loops had a tendency to form a rosette-like pattern throughout, that is lay themselves on top of one another, albeit at an angular offset, and extend substantially radially along parallel planes normal to the longitudinal axis of the drawstring arrangement 13, the finished article 10 of the present invention will exhibit, because of the presence of the branches 12*a* and 12*b*, an even more desirable rather intricate, pom-pon like, substantially semi-spherical shape. This is so because the ribbon material of the branches 12*a* and 12*b* is forced, so to speak, to vie or compete for the same space and becomes deflected upwardly as considered in FIG. 4 of the drawing in the process, thus filling the space that used to be void in the past.

Figure 4:
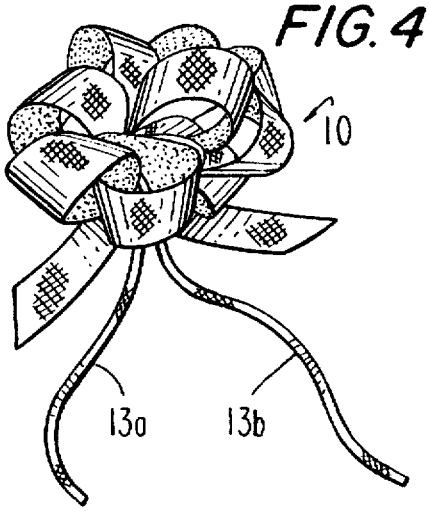
FIG. 4 is another view similar to that of FIG. 1 but this time taken after the completion of the conversion.

Once the conversion of the article 10 into its final state is completed, the drawstrings 13*a* and 13*b* may be knotted adjacent the free ends of the segments 15*a.n* and 15*b.n* located at the underside of the finished article as considered in its preferred position of use corresponding to that shown in FIG. 4, and the remaining free ends of the drawstrings 13*a* and 13*b* may be cut off. Alternatively, such remaining free ends may be used for securing the finished adorning article 10 in the desired position relative to a parcel or package to be decorated by the article, or may even be used for tying such a package.

The article 10 may be furnished to the users in its essentially flat precursor form with an adhesive-backed card having an opening through which the free ends of the drawstrings 13*a* and 13*b* either extend already, or are to extend. The adhesive-coated surface of such a card may initially be covered by a release paper that is removed by the user after completion of the formation of the finished article 10 in order to assist in or accomplish securing of the finished article 10 to the package or another item to be decorated.

As already alluded to or even explained before, the bow-forming article precursor 10 may be packed flat for storage and transport. So, for instance, the article precursor may be folded about the narrow neck portions 18, with the segments 15*a*.1 to 15*b.n* of the stem 12*c* and branches 12*a* and 12*b* being folded one on the other, to provide a compact folded structure.

In another embodiment, the stem portions can be eliminated altogether, it being sufficient to connect the main ribbon sections together at the merger region.

It will be understood that each of the elements described above, or two or more together, may also find a useful application in other types of constructions differing from the type described above.

While the present invention has been described and illustrated herein as embodied in a specific construction of an adorning or decorative article, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An adorning article comprising:

a) a pair of elongated main ribbon section merging with one another at a merger region, each of said main ribbon sections being subdivided into a predetermined number of successive main segments interconnected with one another by respective intervening neck portions;

b) a pair of elongated auxiliary ribbon sections each having at least one auxiliary segment juxtaposed with an adjacent main segment of a respective main ribbon section;

c) means for connecting said main ribbon sections to one another at said merger region, and for connecting each said at least one auxiliary segment to its respectively adjacent juxtaposed main segment; and d) a pair of drawstrings passing jointly through said merger region and individually between said auxiliary and adjacent main segments, with freedom of longitudinal movement, and each separately secured to an end region present between said auxiliary and adjacent main segments.

2. The adorning article as defined in claim 1, wherein each main ribbon section includes a stem portion and a branch portion, and wherein said successive main segments are located both on each stem portion and each branch portion.

3. The adorning article as defined in claim 2, wherein each auxiliary ribbon section is of one-piece with a respective main ribbon section.

4. The adorning article as defined in claim 2, wherein said connecting means is operative for connecting said main ribbon sections to one another at each of said neck portions located on said stem portions and said branch portions.

5. The adorning article as defined in claim 4, wherein said drawstrings are sandwiched between said stem portions and pass jointly through said neck portions of said stem portions, and individually through said neck portions of said branch portions.

6. The adorning article as defined in claim 4, wherein said connecting means includes a multitude of individual retainer members, at least those of said retainer members that are disposed on said stem portions of said main ribbon sections being inclined at predetermined angles with respect to the transverse width of said ribbon sections.

7. The adorning article as defined in claim 2, wherein each of said branch portions includes at least one of said segments situated next to said merger region that has no other of said segments of the same one of said branches associated therewith to constitute a weakened region at which deformation of said segments into loops preferentially commences in response to pulling on said drawstrings.

8. The adorning article as defined in claim 2, and further comprising a pair of incisions extending from respective edges of the respective one of said main and auxiliary ribbon sections within said stem and branch portions and at said merger region toward each other but terminating short of meeting each other to define the respective one of said neck portions.

9. The adorning article as defined in claim 1, wherein each ribbon section is constituted of a foldable material.

10. An adorning article comprising:

a) a pair of elongated ribbons each including a stem portion and a branch portion merging with one another at a merger region, each of said ribbons being subdivided into a predetermined number of successive segments located both on said stem and branch portions thereof and interconnected with one another by respective intervening neck portions, at least one of said segments of each of said branch portions being folded back into juxtaposition with an adjacent segment of the same branch portion;

b) means for connecting said ribbons to one another at each of said neck portions located on said stem portion between said successive segments and at said merger region, and said at least one folded-back segment of each of said branch portions to that of said neck portions that connects said adjacent segment with the next one; and c) a pair of drawstrings sandwiched between said stem portions of said ribbons, passing jointly through said neck portions of said stem portion and of said merger region and individually through said neck portions of said branch portions and between said folded-over and adjacent segments, with freedom of longitudinal movement, and each separately secured to a fold region present between said folded-over and adjacent segments.

11. The adorning article as defined in claim 10, wherein each of said branch portions includes at least one of said segments situated next to said merger region that has no other of said segments of the same one of said branches associated therewith to constitute a weakened region at which deformation of said segments into loops preferentially commences in response to pulling on said drawstrings.

12. The adorning article as defined in claim 10, wherein said connecting means includes a multitude of individual retainer members, at least those of said retainer members that are disposed on said stem portions of said ribbons being inclined at predetermined angles with respect to the transverse width of said ribbons.

13. The adorning article as defined in claim 10, and further comprising a pair of incisions extending from respective edges of the respective one of said ribbons within said stem and branch portions and at said merger region toward each other but terminating short of meeting each other to define the respective one of said neck portions.

14. The adorning article as defined in claim 10, wherein each ribbon is constituted of a foldable material.

15. An adorning article comprising:

a) a pair of elongated ribbons each including a stem portion and a branch portion merging with one another at a merger region, each of said ribbons being subdivided into a predetermined number of successive segments located both on said stem and branch portions thereof and interconnected with one another by respective intervening neck portions formed, in each instance, by a pair of incisions extending from respective edges of the respective one of said ribbons within said stem and branch portions and at said merger region toward each other but terminating short of meeting each other to define the respective one of said neck portions, at least one of said segments of each of said branch portions being folded back into juxtaposition with an adjacent segment of the same branch portion;

b) means for connecting said ribbons to one another at each of said neck portions located on said stem portion between said successive segments and at said merger region, and said at least one folded-back segment of each of said branch portions to that of said neck portions that connects said adjacent segment with the next one; and c) a pair of drawstrings sandwiched between said stem portions of said ribbons, passing jointly through said neck portions of said stem portion and of said merger region and individually through said neck portions of said branch portions and between said folded-over and adjacent segments, with freedom of longitudinal movement, and each separately secured to a fold region present between said folded-over and adjacent segments.

16. The adorning article as defined in claim 15, wherein each of said branch portions includes at least one of said segments situated next to said merger region that has no other of said segments of the same one of said branches associated therewith to constitute a weakened region at which deformation of said segments into loops preferentially commences in response to pulling on said drawstrings.

17. The adorning article as defined in claim 15, wherein said connecting means includes a multitude of individual retainer members, at least those of said retainer members that are disposed on said stem portions of said ribbons being inclined at predetermined angles with respect to the transverse width of said ribbons.

* * * * *